US009127837B2

(12) United States Patent
Proscia et al.

(10) Patent No.: US 9,127,837 B2
(45) Date of Patent: Sep. 8, 2015

(54) LOW PRESSURE DROP, LOW $NO_x$, INDUCED DRAFT GAS HEATERS

(75) Inventors: William Proscia, Marlborough, CT (US); Scott A. Liljenberg, Wethersfield, CT (US); William J. Roy, Avon, IN (US); Duane C. McCormick, Colchester, CT (US); Christopher T. Chipman, Killingly, CT (US)

(73) Assignee: Carrier Corporation, Farmington, CT (US)

( * ) Notice: Subject to any disclaimer, the term of this patent is extended or adjusted under 35 U.S.C. 154(b) by 1001 days.

(21) Appl. No.: 13/166,361

(22) Filed: Jun. 22, 2011

(65) Prior Publication Data

US 2011/0311924 A1 Dec. 22, 2011

Related U.S. Application Data

(60) Provisional application No. 61/357,298, filed on Jun. 22, 2010.

(51) Int. Cl.
*F23D 14/04* (2006.01)
*F23M 20/00* (2014.01)

(52) U.S. Cl.
CPC ..... *F23D 14/04* (2013.01); *F23M 20/005* (2015.01); *F23D 2210/00* (2013.01)

(58) Field of Classification Search
CPC ..... F23D 2210/00; F23D 14/04; F23D 2203/007; F23D 2206/0094; F23M 99/005
See application file for complete search history.

(56) References Cited

U.S. PATENT DOCUMENTS

| | | | | | |
|---|---|---|---|---|---|
| 1,434,256 | A | * | 10/1922 | Thompson | 431/8 |
| 1,540,678 | A | * | 6/1925 | Baxter | 431/347 |
| 1,604,783 | A | * | 10/1926 | Pickup | 239/552 |
| 1,620,111 | A | * | 3/1927 | Lewis | 431/62 |
| 1,691,169 | A | * | 11/1928 | Reinecke | 239/288.5 |
| 1,901,716 | A | * | 3/1933 | Antrim | 239/557 |
| 1,908,135 | A | * | 5/1933 | Forster | 239/432 |
| 1,939,240 | A | * | 12/1933 | Swain | 239/557 |
| 1,966,399 | A | * | 7/1934 | Te Pas et al. | 122/250 R |
| 2,185,886 | A | * | 1/1940 | Caldwell | 239/417 |
| 2,564,358 | A | * | 8/1951 | Fowler | 431/174 |

(Continued)

OTHER PUBLICATIONS

Lennox Installation Instructions for the G60UHV(X) Series Gas Furnace, 506177-01, Oct. 2008.*

(Continued)

*Primary Examiner* — Gregory Huson
*Assistant Examiner* — Martha Becton
(74) *Attorney, Agent, or Firm* — Miller, Matthias & Hull LLP

(57) ABSTRACT

An improved induced draft gas burner assembly for low $NO_x$ residential and light commercial gas furnaces is disclosed. The improved burner includes an upstream assembly coupled to a fuel inlet and an air inlet. The air inlet is coupled to a neck extending between the air inlet and the outlet of the neck, both of which may be disposed within an optional chamber. If used, such a chamber also includes an outlet coupled to a burner. In practice, the chamber and neck behave as a Helmholtz resonator that can be tuned to provide an upstream impedance $Z_{up}$ that exceeds the downstream impedance $Z_{down}$ of the components downstream of the burner assembly.

6 Claims, 8 Drawing Sheets

(56) References Cited

U.S. PATENT DOCUMENTS

| | | | | | |
|---|---|---|---|---|---|
| 2,695,053 | A | * | 11/1954 | Durr et al. | 431/1 |
| 2,807,931 | A | * | 10/1957 | Bodine, Jr. | 60/208 |
| 2,849,220 | A | * | 8/1958 | Duffy et al. | 432/31 |
| 3,050,111 | A | * | 8/1962 | Hubbard et al. | 431/243 |
| 3,246,842 | A | * | 4/1966 | Huber | 237/33 |
| 3,545,902 | A | * | 12/1970 | Bailey | 431/9 |
| 3,580,512 | A | | 5/1971 | Smith et al. | |
| 3,690,807 | A | * | 9/1972 | Paxton et al. | 431/1 |
| 3,741,708 | A | * | 6/1973 | Bernstein | 431/28 |
| 4,060,374 | A | * | 11/1977 | Kwait | 431/190 |
| 4,122,999 | A | * | 10/1978 | Belcastro et al. | 236/11 |
| 4,221,557 | A | * | 9/1980 | Jalics | 431/22 |
| 4,856,981 | A | * | 8/1989 | Flanagan | 431/1 |
| 5,211,704 | A | * | 5/1993 | Mansour | 431/2 |
| 5,353,721 | A | * | 10/1994 | Mansour et al. | 110/345 |
| 5,373,695 | A | * | 12/1994 | Aigner et al. | 60/804 |
| 5,431,018 | A | * | 7/1995 | Keller | 60/724 |
| 5,516,280 | A | * | 5/1996 | Kostiuk et al. | 431/350 |
| 5,525,056 | A | * | 6/1996 | Sutton | 431/328 |
| 5,718,573 | A | | 2/1998 | Knight et al. | |
| 5,816,793 | A | * | 10/1998 | Nakamoto et al. | 431/114 |
| 5,997,285 | A | * | 12/1999 | Carbone et al. | 431/354 |
| 6,106,276 | A | * | 8/2000 | Sams et al. | 431/114 |
| 6,205,764 | B1 | * | 3/2001 | Hermann et al. | 60/776 |
| 6,305,927 | B1 | * | 10/2001 | Keller | 431/114 |
| 6,351,947 | B1 | * | 3/2002 | Keller et al. | 60/725 |
| 6,370,879 | B1 | * | 4/2002 | Stalder et al. | 60/725 |
| 6,430,933 | B1 | * | 8/2002 | Keller | 60/772 |
| 6,464,489 | B1 | * | 10/2002 | Gutmark et al. | 431/1 |
| 6,546,729 | B2 | * | 4/2003 | Hellat et al. | 60/725 |
| 6,694,926 | B2 | * | 2/2004 | Baese et al. | 122/14.2 |
| 6,736,634 | B2 | | 5/2004 | Manohar et al. | |
| 6,820,431 | B2 | | 11/2004 | McManus et al. | |
| 6,860,734 | B2 | * | 3/2005 | Zia et al. | 431/354 |
| 6,889,686 | B2 | * | 5/2005 | Specht | 126/110 R |
| 6,981,358 | B2 | * | 1/2006 | Bellucci et al. | 60/39.17 |
| 7,201,882 | B2 | * | 4/2007 | Cesa | 422/186.04 |
| 7,424,804 | B2 | | 9/2008 | Bellucci et al. | |
| 7,457,710 | B2 | | 11/2008 | Schuermans et al. | |
| 7,788,926 | B2 | * | 9/2010 | Johnson et al. | 60/725 |
| 8,635,874 | B2 | * | 1/2014 | Eroglu et al. | 60/725 |
| 8,839,624 | B2 | * | 9/2014 | Schnell et al. | 60/725 |
| 2002/0037487 | A1 | * | 3/2002 | Olsson | 431/1 |
| 2002/0092482 | A1 | * | 7/2002 | Bodnar et al. | 122/15.1 |
| 2005/0106519 | A1 | * | 5/2005 | Flohr et al. | 431/114 |
| 2005/0223707 | A1 | * | 10/2005 | Ikeda et al. | 60/725 |
| 2006/0123791 | A1 | * | 6/2006 | Macquisten et al. | 60/725 |
| 2006/0207259 | A1 | * | 9/2006 | Holt et al. | 60/772 |
| 2007/0015099 | A1 | | 1/2007 | Wiedenhoefer et al. | |
| 2008/0087019 | A1 | * | 4/2008 | Macquisten et al. | 60/725 |
| 2008/0216481 | A1 | * | 9/2008 | Pollarolo | 60/725 |
| 2009/0311641 | A1 | * | 12/2009 | Berthold et al. | 431/10 |

OTHER PUBLICATIONS

Univeristy of New South Wales online publication "Helmholtz Resonance"; http://newt.phys.unsw.edu.au/jw/Helmholtz.html; Jul. 14, 2007 (date via web.archive.org).*

Lennox Installation Instructions for the G60UHV(X) Series Gas Furnace; 506177-01; Oct. 2008.*

University of New South Wales online publication "Helmholtz Resonance," Jul. 14, 2007.*

Peter K. Baade; "*Design Criteria and Models for Preventing Combustion Oscillations*"; article; Oct. 2, 2008; pp. 449-465; Syracuse, NY.

* cited by examiner

FIG.4A
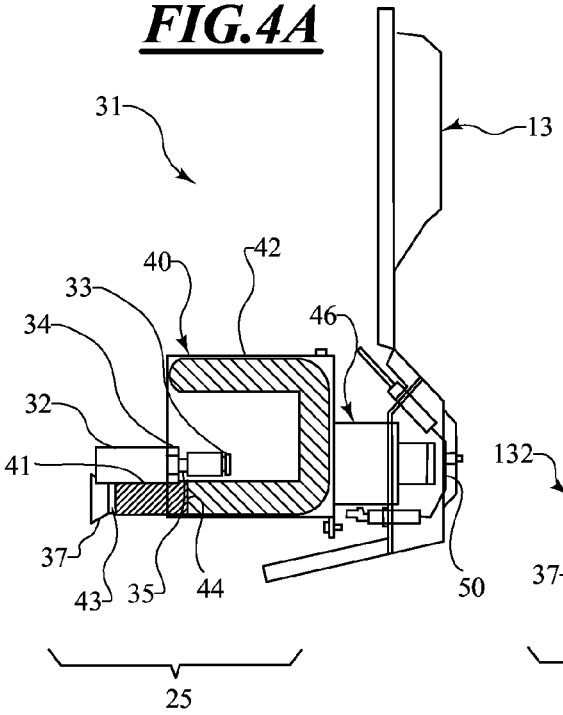
FIG.4B
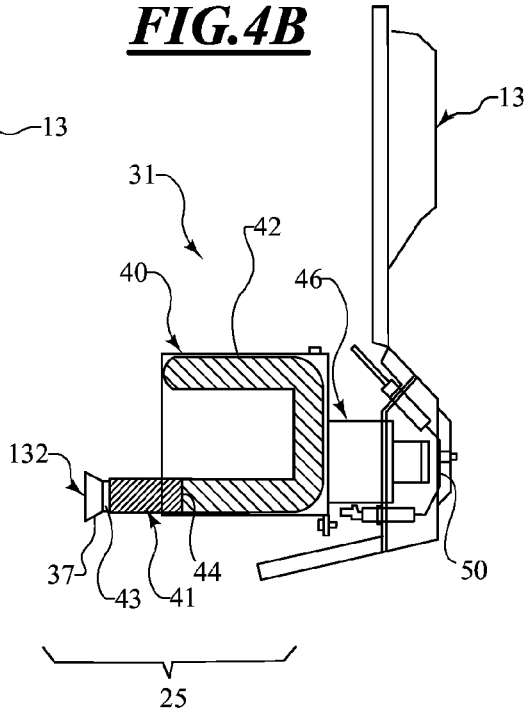
FIG.5
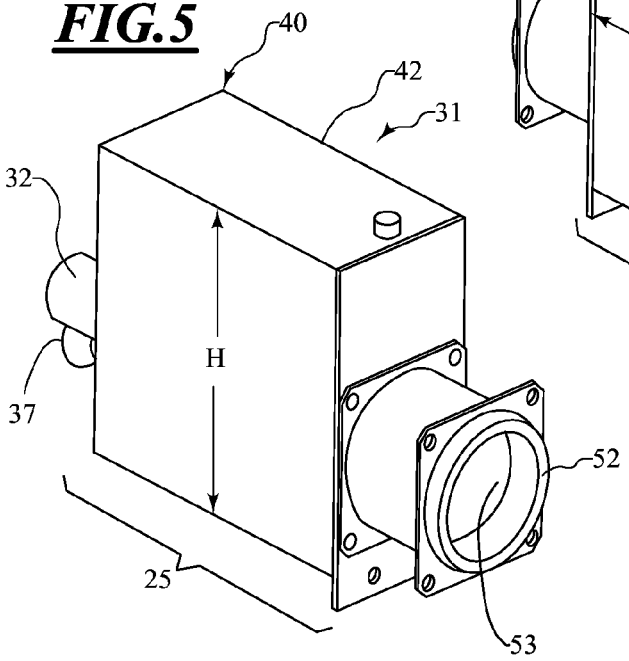
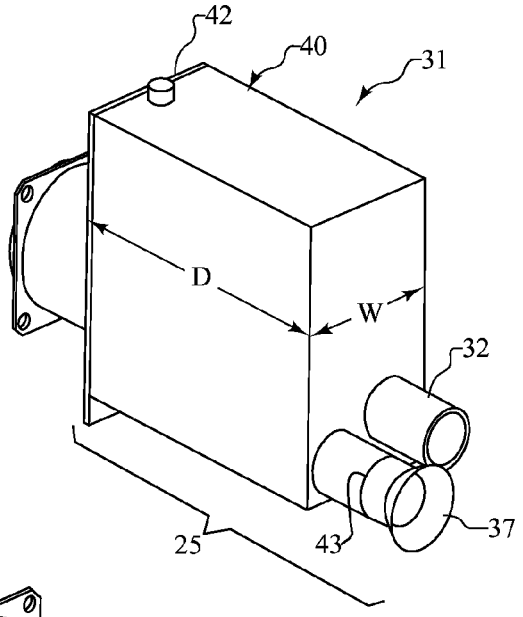
FIG.6

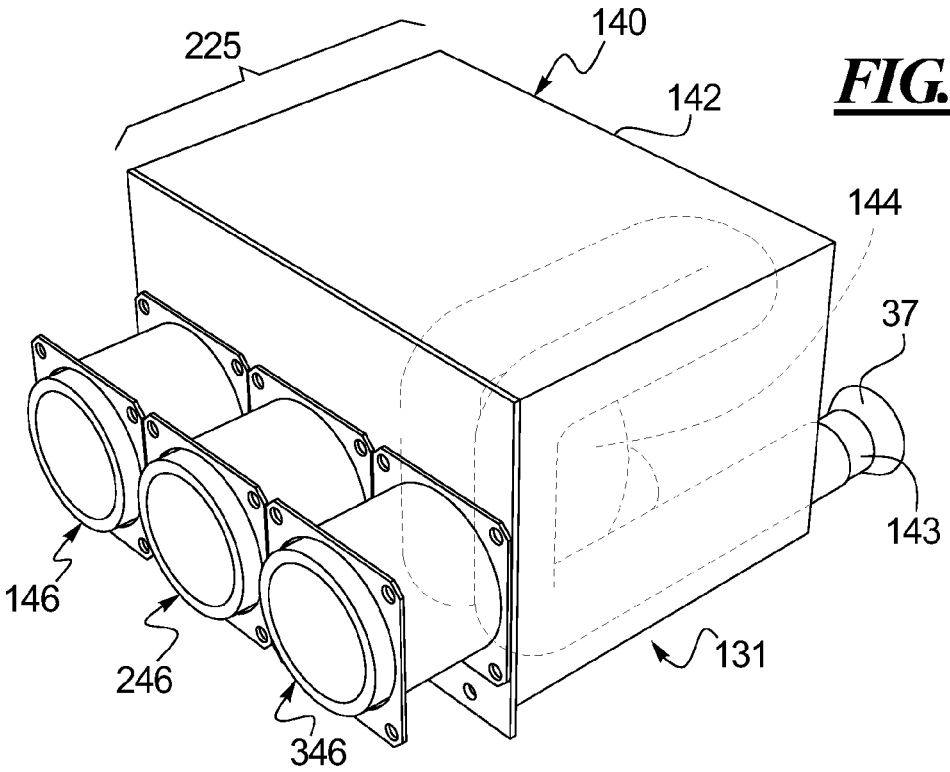
FIG. 9
FIG. 10
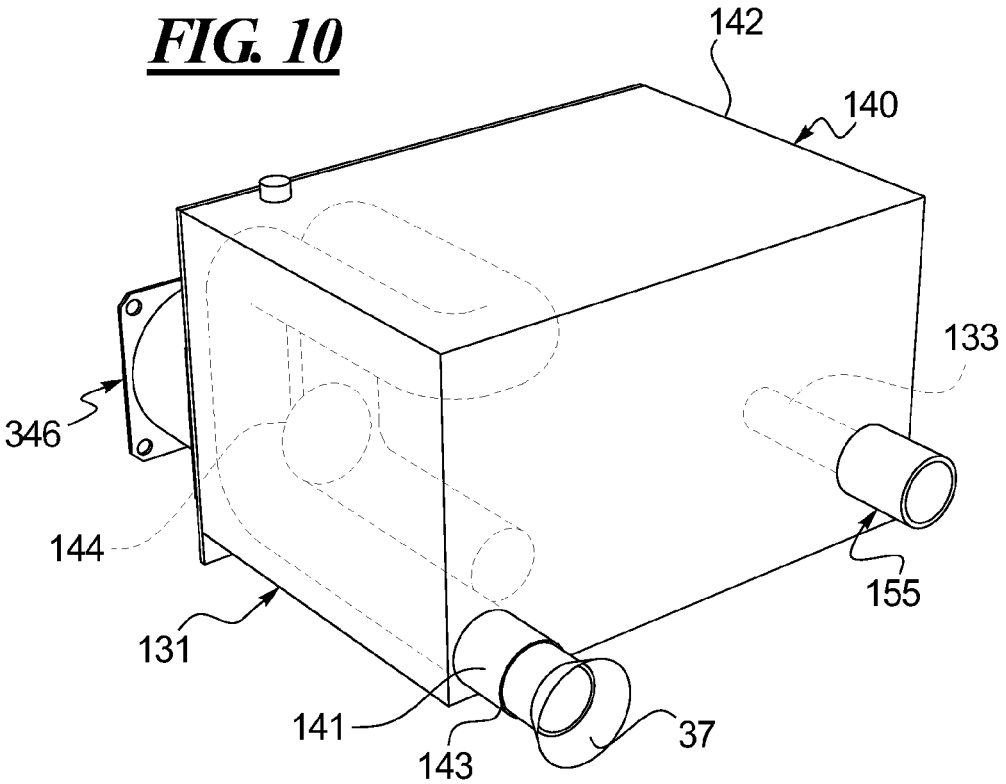

LOW PRESSURE DROP, LOW $NO_x$, INDUCED DRAFT GAS HEATERS

BACKGROUND

1. Technical Field

This disclosure relates generally to gas fired combustion apparatuses such as residential and light commercial furnaces or heaters. More specifically, this disclosure relates to a combustion system for use in such a gas fired apparatus characterized by a reduced level of emission of oxides of nitrogen ($NO_x$) that are obtained, at least in part, by premixing the fuel and air prior to ignition. Still more specifically, this disclosure relates to a low-pressure drop, premixed fuel/air, induced draft gas burner with an inlet or upstream geometry that stabilizes the system and produces a stable flame.

2. Description of the Related Art

The combustion natural gas, liquefied natural gas and propane forms NO with other combustion products. Because these fuels contain little or no fuel-bound nitrogen per se, oxygen and nitrogen in the air that react at the high combustion temperatures are responsible for the formation of $NO_x$. Governmental agencies have passed legislation regulating $NO_x$ emissions by gas furnaces and other devices. For example, in certain areas of the United States, e.g., California, regulations limit the permissible emission of $NO_x$ from residential furnaces to 40 ng/J (nanograms/Joule of useful heat generated). Future regulations will most likely restrict $NO_x$ emissions from residential furnaces from 40 to less than 15 ng/J.

Current gas furnaces often use a particular type of gas burner commonly referred to as an in-shot burner or two-stage burner. Such burners include a burner nozzle having an inlet at one end for receiving separate fuel and primary air streams and an outlet at the other end through which mixed fuel and primary air discharges from the burner towards the heat exchanger. Fuel gas under pressure passes through a central port disposed at or upstream of the inlet of the burner. The diameter of the inlet to the burner is larger than the diameter of the fuel inlet to form an annular area through which atmospheric air (a.k.a. primary air) enters the burner nozzle with the incoming fuel gas. The burner may include a straight or arcuate tube having an inlet section, an outlet section and a transition section disposed therebetween, which is commonly referred to as a Venturi section.

The primary air mixes with the fuel gas as it passes through the tubular section of the burner to form a primary air/gas mix. This primary air/gas mix discharges from the burner and ignites as it exits the nozzle outlet section forming a flame projecting downstream from a flame front located immediately downstream of the burner outlet and in front of a heat exchanger inlet. An inducer fan draws secondary airflow into the burning mixture downstream of the burner and into the heat exchanger with the combusting gases in order to provide additional air to support combustion.

In order to comply with current and future $NO_x$ regulations, new burner designs will replace the current in-shot burner designs. The new burner designs will premix the air and fuel before combustion, without the aid of secondary air. The new premix burner designs are coupled to the heat exchanger inlet instead of providing a gap between the burner and heat exchanger, which allows for the entrainment of secondary air. By eliminating the use of secondary air, the premix burners control the premixing of the fuel and air and provide a lean mixture for combustion, which produces less $NO_x$ than traditional in-shot burners.

One problem associated with such premix burner designs is noise caused by pressure fluctuations. Pressure fluctuations in a fuel nozzle may cause fuel flow-rate fluctuations. Fuel flow-rate fluctuations may interact with the burner flame to produce pressure oscillations. The resulting fluctuation cycles may lead to oscillations with relatively large amplitude depending upon the magnitude and phase of the interactions. In short, pressure fluctuations lead to flame instability, which leads to undesirable noise.

Although feedback analysis is known to those of ordinary skill in the art of combustion dynamics, what is still needed are systems and methods that apply feedback analysis in the context of induced draft heating devices such as residential gas furnaces and other practical applications without interfering with efforts to reduce $NO_x$ and/or CO emissions.

SUMMARY OF THE DISCLOSURE

Induced draft/gas fired burner assemblies are disclosed that fulfill the following requirements: low $NO_x$ emissions; reduced noise levels; and improved flame stability. The disclosed burner assemblies achieve the low $NO_x$ emissions, reduced noise levels and improved flame stabilities by modifying the geometry upstream of the burner so that an acoustic impedance ($Z_{up}$) of air and optionally fuel flow upstream and towards the burner exceeds the acoustic impedance ($Z_{down}$) of combustion gases flowing downstream and away from the burner through the heat exchanger, inducer fan and related ducts.

One disclosed burner assembly comprises an upstream assembly that comprises at least one inlet for receiving air and, optionally, fuel, which may be separate or integrated with the air inlet. The upstream assembly may define a volume that receives the incoming air (and, optionally, the fuel as well) and that provides a route between the inlet and an outlet coupled to the burner. Application space dimensions that typically include width per burner, depth and height define the volume. In general, the volume is the space consumed by the geometry of the upstream assembly. In any event, when the upstream geometry is properly tuned or matched so that the upstream impedance $Z_{up}$ of air an fuel flow towards the burner exceeds the downstream impedance $Z_{down}$ of combustion gases flowing the downstream of the burner through heat exchanger, inducer fan and related ducts. It has been found that creating a $Z_{up}>Z_{down}$ condition results in a stable and quiet flame at the burner while maintaining low $NO_x$ emissions.

In another aspect, an improved induced draft, environmentally sound residential gas furnace comprises a burner assembly comprising a plurality of burners. Each burner may comprise an upstream assembly comprising a burner coupled to at least one inlet for receiving fuel and air and a volume having a geometry that in combination with a geometry and resonant frequency of the heat exchanger, downstream ducts and inducer fan, results in a $Z_{up}>Z_{down}$ condition that provides for a stable and quiet flame at the burner while maintaining low $NO_x$ emissions.

A method for designing an improved induced draft gas burner is also disclosed which manipulates the upstream geometry (i.e., upstream of the burner) in order to stabilize the system by creating a $Z_{up}>Z_{down}$ condition. The upstream design accommodates for the acoustic properties of the downstream heat exchanger, inducer fan and related ducting. The upstream design may vary significantly if the downstream geometries (lengths, cross sectional areas, boundary conditions, geometry, etc.) of the heat exchanger change as the downstream geometries determine the downstream acoustic properties. In one refinement, air and optionally fuel flowing through an effective inlet has an acoustic impedance $Z_{up}$ that is greater than the acoustic impedance $Z_{down}$ of combustion gases flowing through the downstream parts of the system. It has been found that creating this condition provides flame stability while maintaining low $NO_x$ emissions.

In another refinement, instead of varying the upstream geometry, the heat output rate in terms of heat per unit time and per unit with of burner spacing, may be varied. Using this methodology, the BTU/hr·in. width of burner spacing may be varied from about 1,000 to about 50,000 BTU/hr·in width of burner spacing.

Other advantages and features will be apparent from the following detailed description when read in conjunction with the attached drawings.

BRIEF DESCRIPTION OF THE DRAWINGS

For a more complete understanding of the disclosed methods and apparatuses, reference should be made to the embodiments illustrated in greater detail in the accompanying drawings, wherein:

FIG. 4A is a side sectional view of a disclosed burner assembly with separate air and fuel inlets, and that is coupled to a primary heat exchanger;

FIG. 4B is a side sectional view of another disclosed burner assembly with integrated air and fuel inlets, and that is coupled to a primary heat exchanger;

FIG. 5 is a front perspective view of the burner assembly disclosed in FIG. 4A;

FIG. 6 is a rear perspective view of the burner assembly disclosed in FIGS. 4A and 5;

FIG. 9 is a front perspective view of a burner assembly comprising a Helmholtz resonator with a single air inlet and a single fuel inlet coupled to three burners;

FIG. 10 is a rear perspective view of the burner assembly of FIG. 9;

DETAILED DESCRIPTION OF THE PRESENTLY PREFERRED EMBODIMENTS

Figure 1:
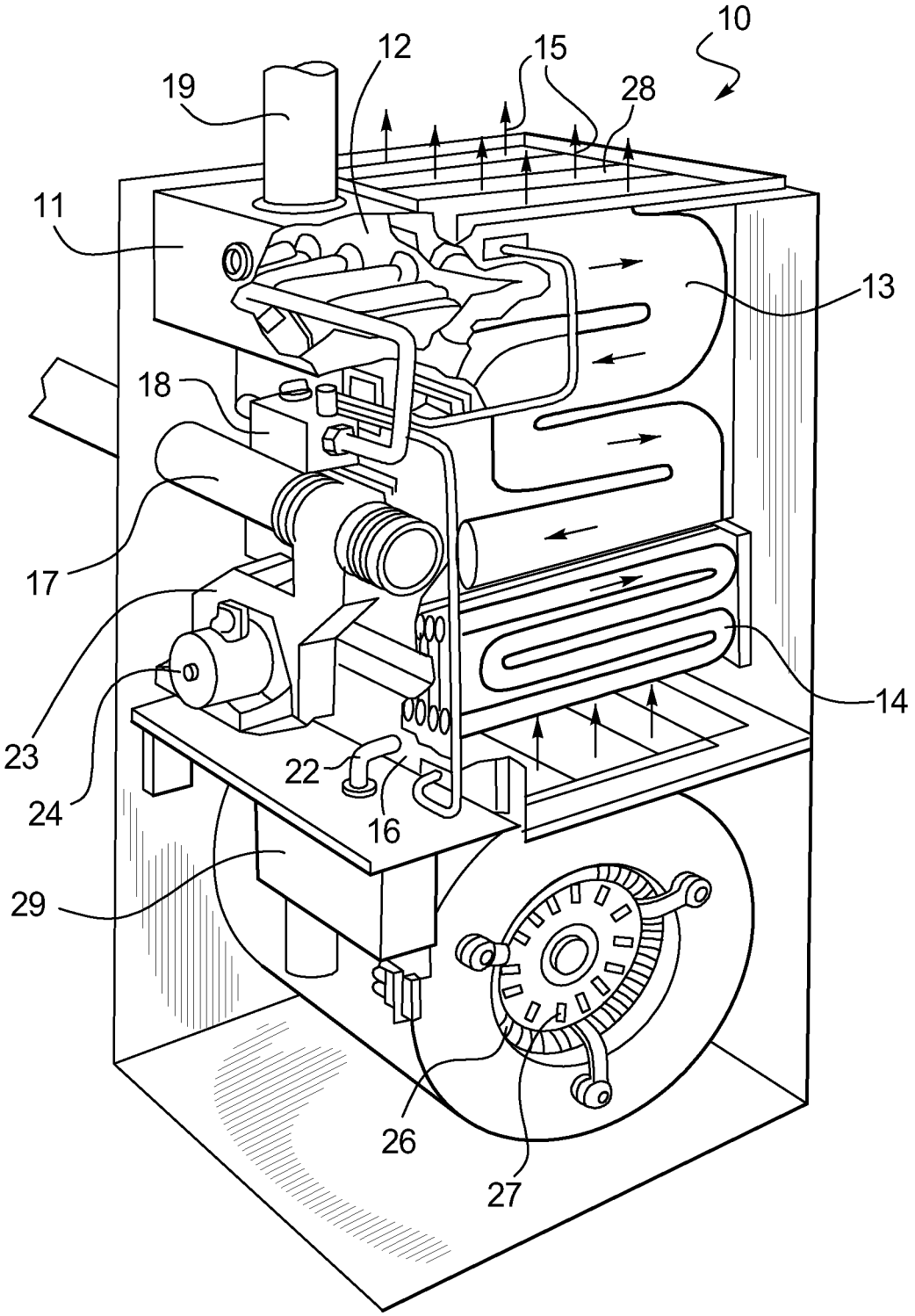
FIG. 1 (PRIOR ART)
FIG. 1 is a perspective view of a prior art gas furnace that includes a burner assembly that comprises a burner box with a plurality of burners coupled to primary heat exchangers.

Referring first to FIG. 1, a modulating gas furnace 10 is shown which comprises a burner assembly 11 with a burner box 12 that is decoupled from the inlets 49 of the primary heat exchanger 13. The primary heat exchanger 13 is in fluid communication with a condensing heat exchanger 14 whose discharge end is fluidly connected to a collector box (not shown) and an exhaust vent 17. In operation, a modulating gas valve 18 meters the flow of gas to the burner assembly 11 where combustion air from an air inlet 19 is mixed and transmitted to the burners (not shown in FIG. 1). The hot gas is then passed through the inlets 49 of the primary heat exchanger 13. The primary heat exchanger 13 leads to the condensing heat exchanger 14, as shown by the arrows 20.

The relatively cool exhaust gases then pass through the collector box 16 and exhaust vent 17 before being vented to the atmosphere, while the condensate flows from the collector box 16 through a drain line (not shown) for disposal. Flow of combustion air into the air inlet through the heat exchangers 13, 14 and the exhaust vent 17 is enhanced by an inducer fan 23. The inducer fan 23 is driven by integrated control motor 24 in response to signals from the integrated furnace control or IFC 29. The household air is drawn into a blower 26, which is driven by a drive motor 27, in response to signals received from the IFC 29. The blower 26 passes the household air over the condensing heat exchanger 14 and the primary heat exchanger 13, in a counter-flow relationship with the hot combustion gases. The household air then flows from the discharge opening 28 in the upward direction as indicated by the arrows 15 to a duct system (not shown) within the space being heated.

Figure 2:
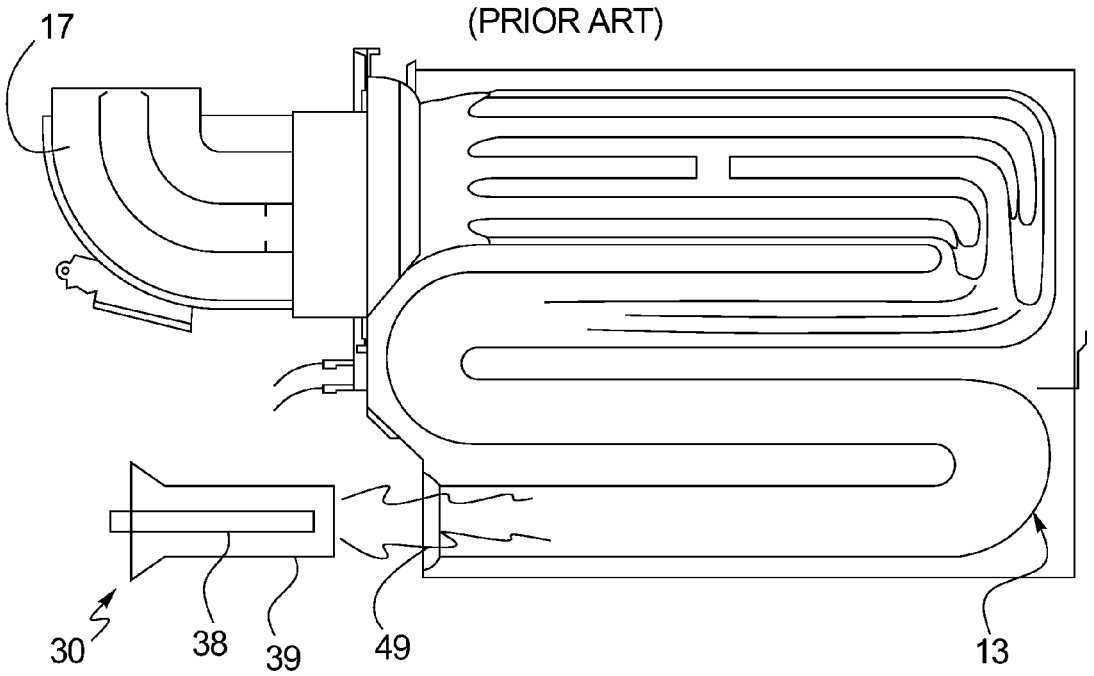
FIG. 2 (PRIOR ART)
FIG. 2 is a schematic illustration of a conventional (prior art) burner coupled to a primary heat exchanger.
Figure 3:
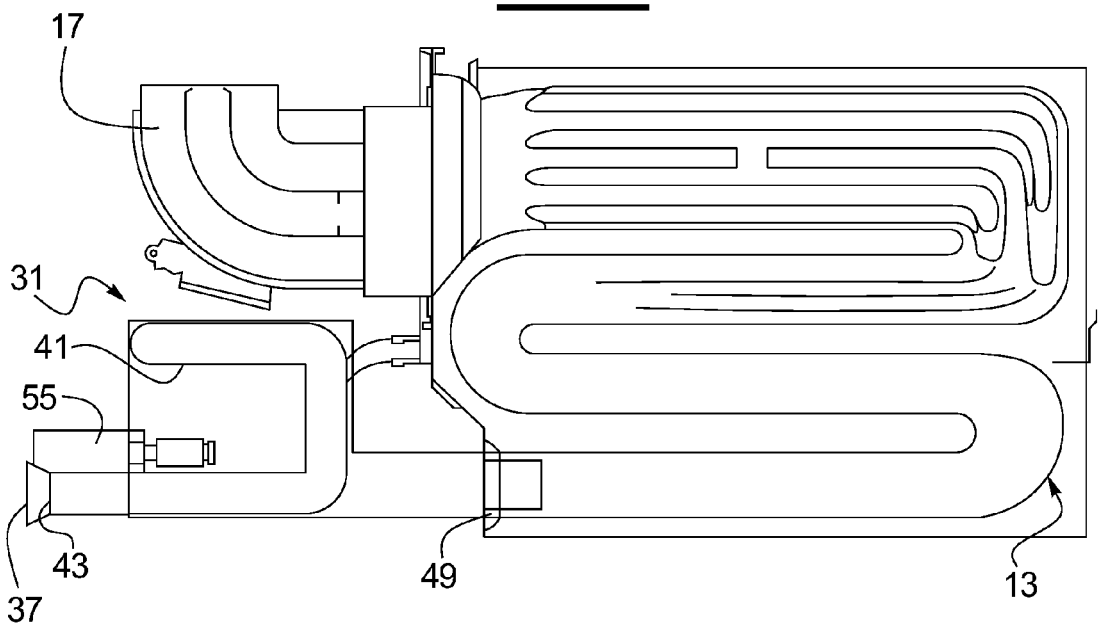
FIG. 3 is a schematic illustration of a disclosed burner assembly coupled to a primary heat exchanger.

Turning to FIG. 2, a conventional burner tube assembly 30 is spaced apart from an inlet 49 of a primary heat exchanger 13. The fuel inlet 38 and air inlet 39 are separate and disposed immediately upstream of inlet 49 of the primary heat exchanger 13. FIG. 3 illustrates a disclosed burner assembly 31 coupled to the inlet 49 of the primary heat exchanger 13.

FIGS. 4A-7 illustrates the disclosed burner assembly 31. Turning to FIG. 4A, a separate fuel supply inlet 32 is provided which is connected to an orifice 33 by an adaptor 34, nipple 35 and coupling 36. FIGS. 3 and 4A-6 illustrate the separate air inlet 43 and contractor 37. In FIG. 4B, the air and fuel supplies are combined into a single inlet 132, which is coupled to the inlet 43 of the neck 41.

Still referring to FIG. 4A, the air supply inlet 43 couples a neck 41 to a contractor 37 to minimize pressure drop, which is important in induced draft applications. Both the fuel supply inlet 32 and neck 41 are coupled to a chamber 42. The neck 41 and chamber 42, in this embodiment, form a Helmholtz resonator.

Figure 7:
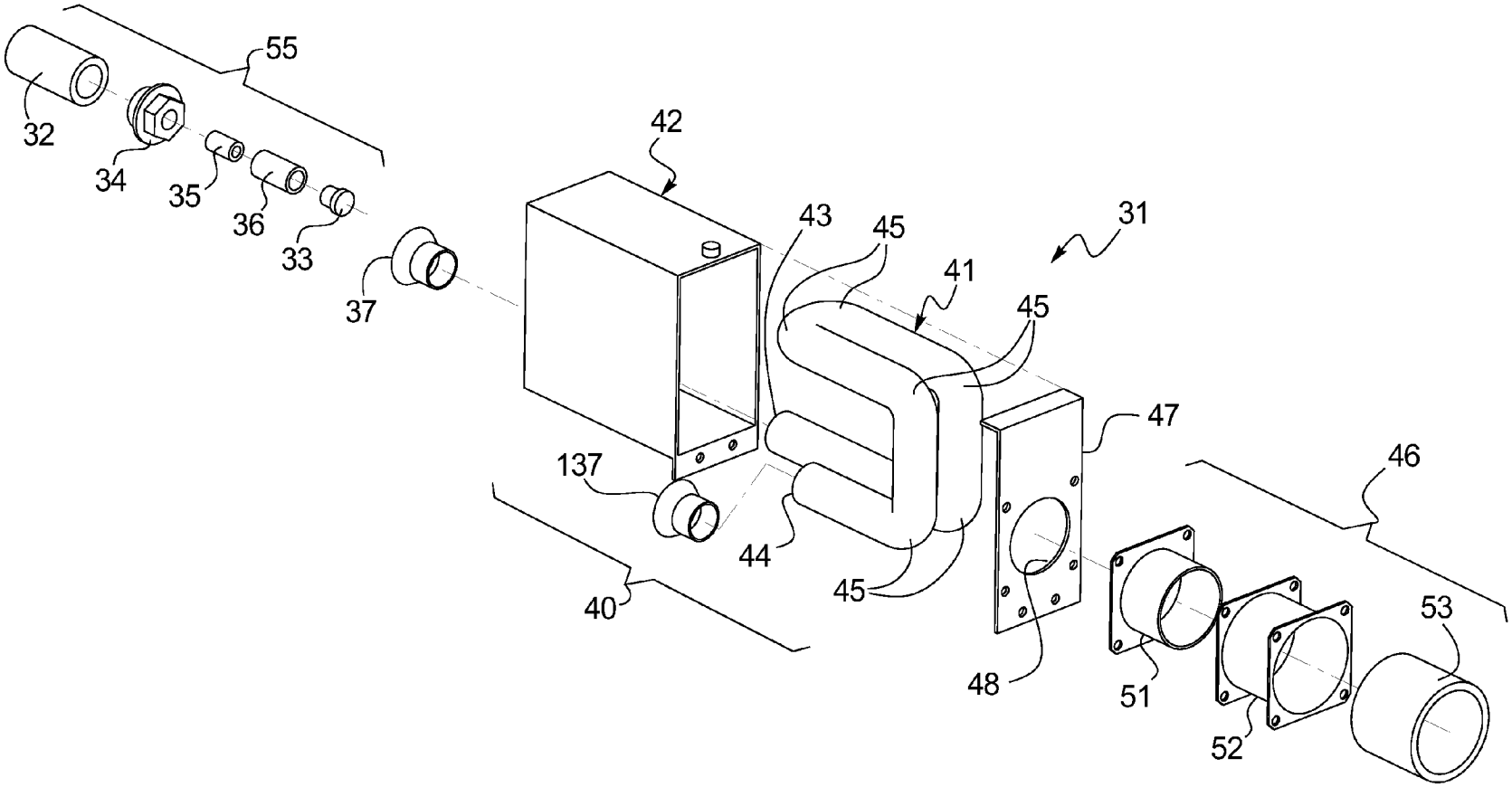
FIG. 7 is an exploded view of the burner assembly illustrated in FIGS. 4A and 5-6.

While the chamber of the Helmholtz resonator 40 accommodates the neck 41 as illustrated in FIGS. 4A and 7, the neck 41 may be disposed outside of the chamber 42. Referring to FIGS. 4A and 7, the neck 41 includes an outlet 44 disposed within the chamber 42, with the gas inlet orifice 33. Like the inlet 43, the air outlet 44 may be equipped with a contractor 137 to minimize pressure drop. The shape and configurations of the contractors 37, 137 may vary and are optional, as will be apparent to those skilled in the art. FIG. 7 illustrates the length of the neck 41, which has a primary function of providing volume for the incoming air in the form of a lengthy route of the air (FIG. 4A) or air and fuel (FIG. 4B) through the neck 41 between the air inlet 43 (FIG. 4A) or combined air/fuel inlet 132 (FIG. 4B) and the air outlet 44. In the embodiment shown, the neck 41 may include multiple bends 45 to provide an overlapping C-shaped configuration for the sake of space conservation. Numerous other configurations for the neck 41 will be apparent to those skilled in the art and are too numerous to mention here. Further, as will be explained in greater detail below, the multiple variations and combinations of volumes of the neck 41 and/or chamber 42 and/or the length of the neck 41 and/or the cross sectional area of the neck 41 can be used to control the upstream acoustic impedance ($Z_{up}$). In general, many combinations of neck volume, chamber volume (if a chamber is utilized), neck cross-sectional area, neck length and the geometries of the neck 41 and optional chamber 42 may be used to find an optimal $Z_{up}$. In addition, of course, any optimized $Z_{up}$ is dependent upon the downstream heat exchanger 13, inducer fan and downstream ducts or, more specifically, the geometry of the downstream heat exchanger 13 and the type of inducer fan and ducting utilized.

The chamber 42 includes an outlet that is coupled to a burner tube assembly 46. Specifically, referring to FIG. 7, the chamber is coupled to an end plate 47 with an outlet opening 48. The outlet opening 48 is coupled to a burner tube 51, which is disposed within an adaptor assembly 52. As noted above, the gas injection assembly 55 includes the inlet or inlet coupling 32, the adaptor 34, the nipple 35, the coupling 36 and the orifice 33.

Front and rear perspective views of a disclosed burner assembly are provided in FIGS. 5 and 6. The chamber 42 of the Helmholtz resonator 40 may be provided in the form of a rectangular box as illustrated in FIGS. 5 and 6. The chamber 42 may be used to provide volume and therefore numerous variations on the general box-shaped chamber 42 illustrated in FIGS. 5-7 will be apparent to those skilled in the art and are too numerous to mention here. The neck 41 may be disposed inside or outside the chamber 42 and variations the general shape of the neck 41 will also be apparent to those skilled in the art are too numerous to mention here. Specifically, the number of bends 45 and the configuration of the neck 41 are less important than the length and cross sectional areas of the neck 41. In other embodiments, see, e.g., FIGS. 13-14, the neck 41 may also provide the needed volume without the use of a chamber 42.

The chamber 42 may be used in a residential furnace or light commercial furnace having multiple burners, typically three burners, but the number of burners may vary from one to six. By way of example only, to fit within an existing furnace having three burners, the dimensions width W, depth D and height H of the chamber 42 (FIGS. 5-6) may range from about 0.5 to about 3.5 inches (about 5.08 to about 8.89 centimeters), from 6.5 to about 9.5 inches (16.51 to about 24.13 centimeters) and from about 2 to about 20 inches (about 5.08 to about 50.8 centimeters) respectively.

Figure 8:
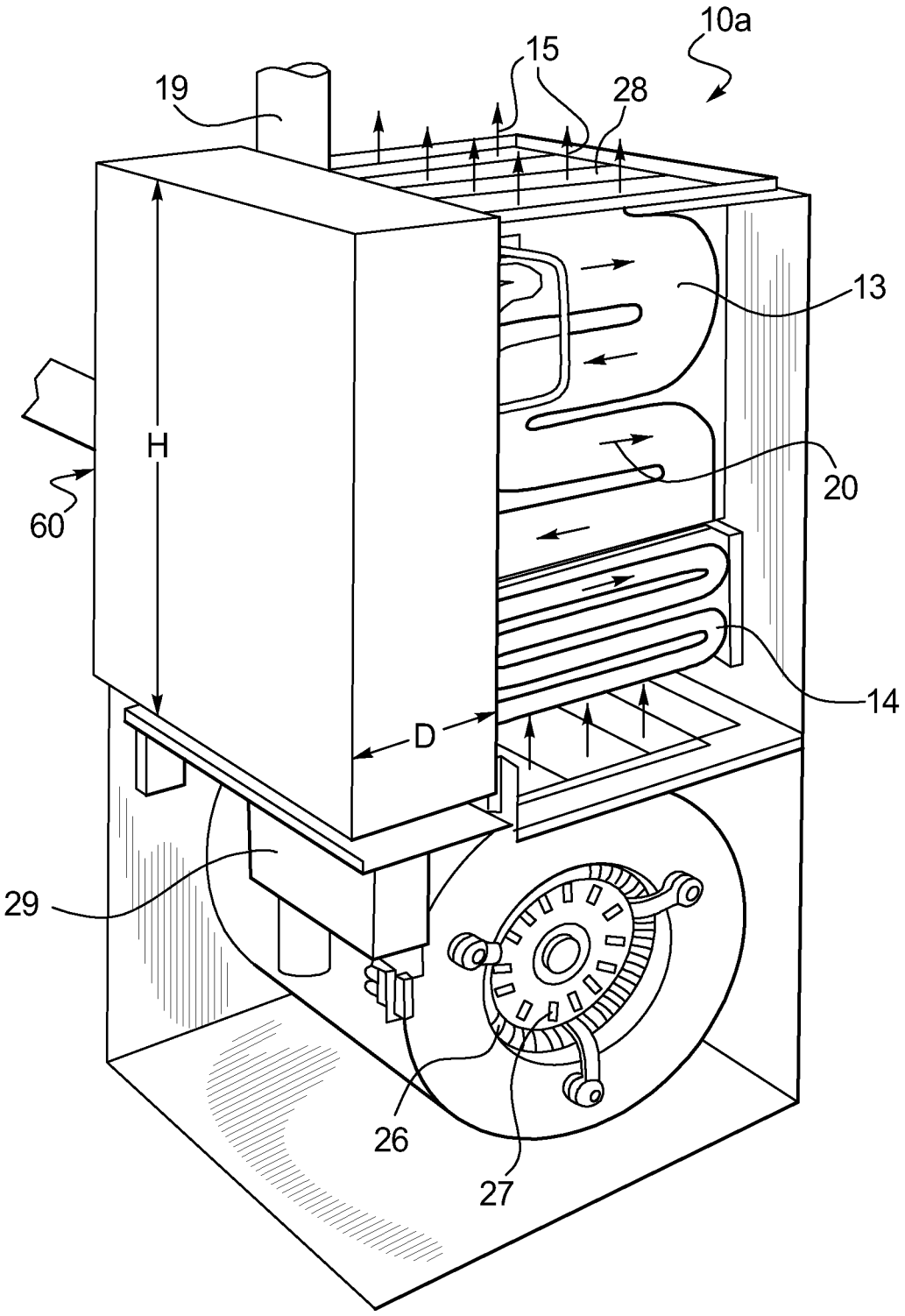
FIG. 8 is a perspective view of a disclosed gas furnace that includes a burner assembly coupled to an upstream assembly that provides an application space for accommodating one or more Helmholtz resonators illustrated in FIGS. 4A-7 and 10-12.

FIG. 8 illustrates a maximum available space or upper limit to the application space 60 for a three-burner furnace 10*a*. The residential furnace industry average available depth D is about 8.8 inches (about 22.35 centimeters) with a maximum of about 9.3 inches (about 23.62 centimeters) and a minimum of about 8.3 inches (about 21.08 centimeters). The residential furnace industry average available height H is about 9.3 inches (about 23.62 centimeters) with a maximum of about 12 inches (about 30.48 centimeters) and a minimum of about 6.8 inches (about 17.27 centimeters). The application space 60 volumes can range from about 139 to about 333 cubic inches (about 2278 to about 5457 cubic centimeters). The residential furnace industry average available volume for such an application space 60 is about 238 cubic inches (about 3900 cubic centimeters). One preferred Helmholtz resonator geometry where one chamber 42 is coupled to one burner assembly 46 has a volume of about 50 cubic inches, with a neck 41 length of about 18 inches and neck cross sectional diameter of about 0.875 inches (2.22 centimeters).

Still referring to FIG. 8, instead of varying the upstream geometry, the heat output rate in terms of heat per unit time and per unit width W of burner spacing, may be varied. Using this methodology, the BTU/hr·in. width W of burner spacing may be varied from about 1,000 to about 50,000 BTU/hr·in. width W of burner spacing.

Figure 11:
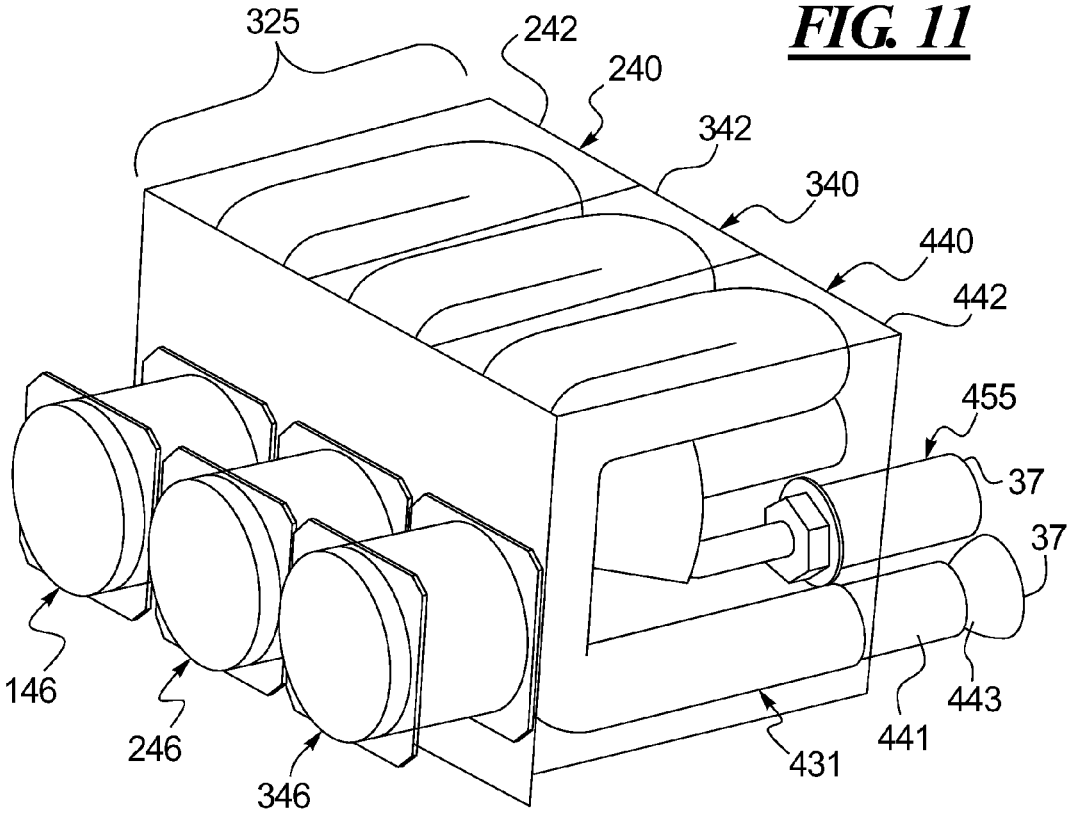
FIG. 11 is a front perspective view of a disclosed burner assembly comprising three Helmholtz resonators coupled to three burners.
Figure 12:
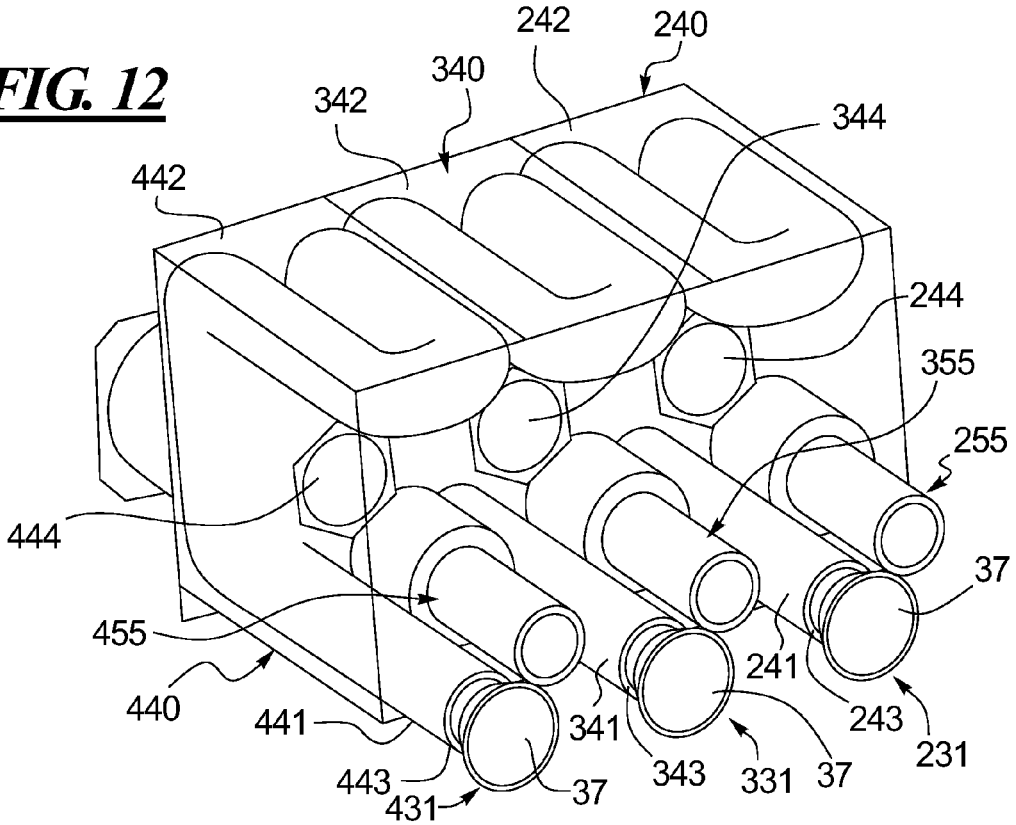
FIG. 12 is a rear perspective view of the burner assembly of FIG. 10.

In addition to the embodiment illustrated in FIGS. 4A-7, various other embodiments are illustrated in FIGS. 9-13. FIGS. 9-10 shows a burner assembly 131 with a single chamber 142 and a single neck 141 for a plurality of burners 146, 246, 346. The burner 131 of FIGS. 9-10 may be useful for residential furnaces or for applications where space is at a premium. The number of burners 146, 246, 346 per Helmholtz resonator 140 may vary from one (1) to six (6) or more. In the example of FIGS. 11-12, each burner assembly 231, 331, 431 may include its own burner 146, 246, 346, chamber 242, 342, 442 and neck 241, 341, 441.

Figure 13:
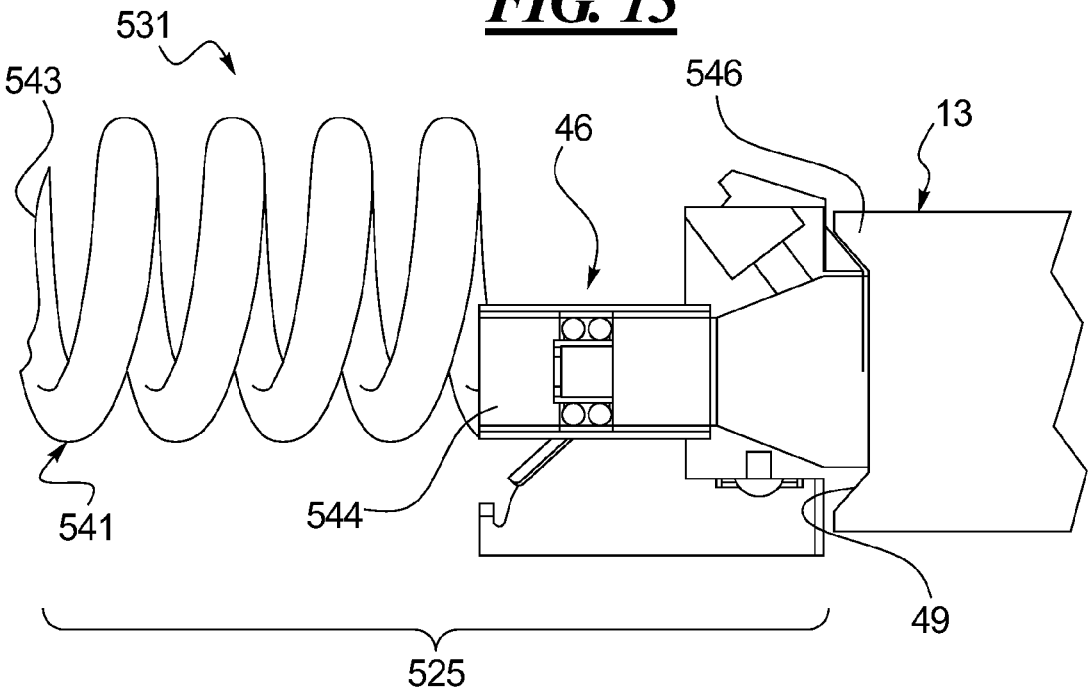
FIG. 13 is a side sectional view of a disclosed burner assembly with a coiled tube inlet/neck and that is coupled to a primary heat exchanger.
Figure 14:
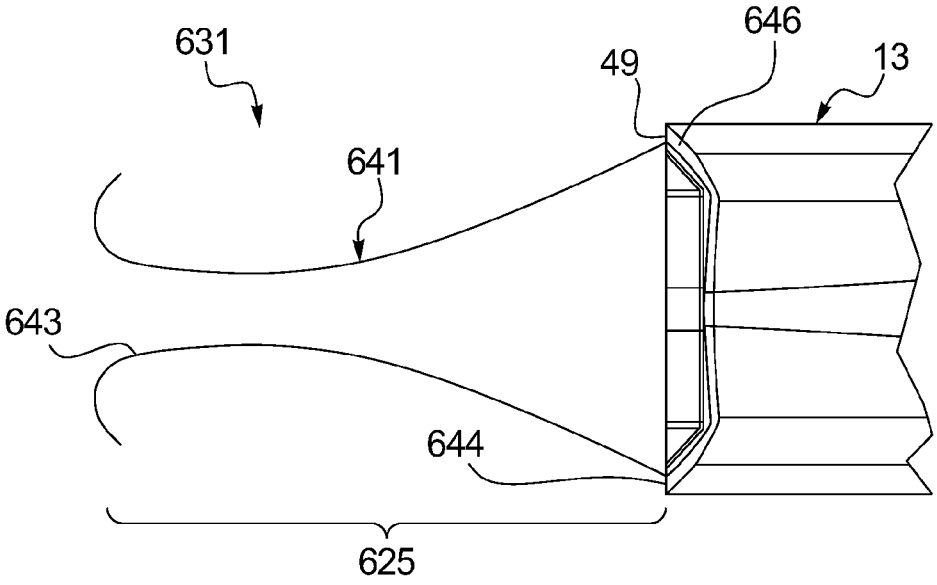
FIG. 14 is a side sectional view of a disclosed burner assembly with a reverse horn-shaped inlet/neck and that is coupled to a primary heat exchanger.

As noted above, other variations include, but are not limited to a coiled tube 541 or a reverse horn-shaped tube 641 as illustrated in FIGS. 13 and 14 as a substitute for a Helmholtz resonators 40, 140, 240, 340, 440 (i.e., the chambers 42, 142, 242, 342, 442 and necks 41, 141, 241, 341, 441). While these geometries work, they may require more pressure drop to work as well as the HRs 40, 140, 240, 340, 440 in an induced draft furnace. The geometries of FIGS. 13-14 highlight the fact that a large impedance at a specific frequency can be obtained with other devices that have different controlling parameters. For the coiled tube 541, the controlling parameters are the tube length and tube cross sectional area. For the horn 641, the controlling parameters are the length of the horn or diffuser, the cross sectional area of the horn or diffuser, which is not constant, and the shape of the horn or diffuser 641.

The equivalence ratio of a system is defined as the ratio of the fuel-to-oxidizer ratio to the stoichiometric fuel-to-oxidizer ratio. Mathematically, $$\phi = \frac{\text{fuel-to-oxidizer ratio}}{(\text{fuel-to-oxidizer ratio})_{st}} = \frac{m_{fuel}/m_{ox}}{(m_{fuel}/m_{ox})_{st}} = \frac{n_{fuel}/n_{ox}}{(n_{fuel}/n_{ox})_{st}}$$

where, m represents the mass, n represents number of moles, suffix sty stands for stoichiometric conditions. The disclosed burner assemblies 31 are useful for lean pre-mixed flames having Φ values ranging about 0.5 to about 0.9, more typically from about 0.65 to about 0.7.

In this disclosure, multiple variables may be used to control the upstream acoustic impedance ($Z_{up}$) and/or flame stability. Those variables include: the volume of the chamber 42, 142, 242, 342, 442; the combined volume of the chamber 42, 142, 242, 342, 442 and neck 41, 141, 241, 341, 441, 541, 641; the volume provided by the cross sectional area and length of the neck 41, 141, 241, 341, 441, 541, 641 if a chamber-less design like those shown in FIGS. 13-14 is utilized; and the length of the neck 41, 141, 241, 341, 441, 541, 641 and the cross sectional area of the neck 41, 141, 241, 341, 441, 541, 641, which may be constant as shown in FIGS. 4A-7, 9-11 and 13 or which may vary as shown in FIG. 14. The geometry or shape of the neck 41, 141, 241, 341, 441, 541, 641 and the volume, cross sectional area and/or length of by neck 41, 141, 241, 341, 441, 541, 641 may also be manipulated to achieve flame stability. Various manipulations of any one or more of these variables can be used by one skilled in the art to stabilize the system for a given downstream heat exchanger 13, provide a stable and quite flame at the burner. The air pipe inlets 43, 143, 243, 343, 443, 543, 643 may or may not be equipped with contractors 37 and the air pipe outlets 44, 144, 244, 344, 444, 544, 644 may or may not be equipped with contractors 137.

While only certain embodiments have been set forth, alternatives and modifications will be apparent from the above description to those skilled in the art. These and other alternatives are considered equivalents and within the spirit and scope of this disclosure and the appended claims.

The invention claimed is:

1. A gas burner assembly, comprising:

an upstream end comprising at least one neck comprising one end in communication with an air supply and optionally a fuel supply and a second end in communication with at least one burner tube, the burner tube is physically coupled to a heat exchanger and via at least one downstream component, the at least one downstream component being disposed opposite the burner tube from the neck, the at least one downstream component comprising a cylindrical portion having a constant cross-section, the neck comprises one or more variables selected from the group consisting of a length, a constant cross-sectional area, a variable cross-sectional area, and a shape or geometry, that provides an upstream impedance (Zup) of air and optionally fuel flowing through the neck that exceeds a downstream impedance (Zdown) of combustion gases flowing through the heat exchanger and downstream components to provide a stable flame at the burner, and at least one chamber wherein the neck and chamber form at least one Helmholtz resonator and wherein the neck is disposed substantially within the chamber.

2. The burner assembly of claim 1 wherein the neck has a geometry selected from the group consisting of a straight tube, a tube with multiple bends and a coiled tube.

3. The burner assembly of claim 1 wherein the neck comprises a tube with a narrow inlet and a wider outlet that is coupled to the burner and that flares gradually outwardly between the inlet and outlet.

4. The burner assembly of claim 1, wherein the fuel inlet and air inlet are both coupled to the neck.

5. A gas furnace, comprising:

a plurality of burner assemblies, each burner assembly comprising at least one burner tube coupled between a heat exchanger and an upstream end, the at least one burner tube physically coupled to the heat exchanger via at least one downstream component, the at least one downstream component being disposed opposite the at least one burner tube from the upstream end, the at least one downstream component comprising a cylindrical portion having a constant cross-section, each upstream end comprising at least one neck comprising one end in communication with an air supply and optionally a fuel supply and a second end in communication with the at least one burner tube, each neck comprising one or more variables selected from the group consisting of a length, a constant cross-sectional area, a variable cross-sectional area, and a shape or geometry, that provides an upstream impedance (Zup) of air and optionally fuel flowing through the neck that exceeds a downstream impedance (Zdown) of combustion gases flowing through the heat exchanger and downstream components to provide a stable flame at the burner, and at least one chamber in communication with at least one neck, the at least one neck and at least one chamber forming at least one Helmholtz resonator wherein the at least one neck comprises a plurality of necks and the at least one chamber comprises a plurality of chambers, each neck is disposed substantially within one of the chambers, each chamber being in communication with one of the burners.

6. The furnace of claim 5 wherein the neck has a geometry selected from the group consisting of a straight tube, a tube with multiple bends, a coiled tube and a tube with a narrow inlet and a wider outlet that is coupled to the burner and that flares gradually outwardly between the inlet and outlet.

* * * * *